United States Patent [19]

Haynes

[11] 4,360,159

[45] Nov. 23, 1982

[54] ADJUSTABLE SHOWER HEAD

[76] Inventor: Joseph C. Haynes, 1206 Lexington Pkwy., Ypsilanti, Mich. 48197

[21] Appl. No.: 203,744

[22] Filed: Nov. 3, 1980

[51] Int. Cl.[3] ..... B05B 15/08

[52] U.S. Cl. ..... 239/282; 4/596; 4/601; 4/605; 239/588

[58] Field of Search ..... 239/208, 281, 282, 283, 239/195, 197, 587, 588, 30; 4/596, 597, 601, 605, 606, 191

[56] References Cited

U.S. PATENT DOCUMENTS

| | | | |
|---|---|---|---|
| 1,982,509 | 11/1934 | Frank | 4/596 |
| 2,118,294 | 5/1938 | Cox | 239/197 |
| 2,174,099 | 9/1939 | Vogler et al. | 239/197 |
| 2,225,271 | 12/1940 | Hope | 239/197 |
| 2,496,520 | 2/1950 | Daniel | 239/282 |
| 2,504,269 | 4/1950 | Logan | 239/197 |
| 2,685,093 | 8/1954 | Lundquist | 4/191 |
| 2,697,839 | 12/1954 | Jackson | 239/282 |
| 3,005,995 | 10/1961 | Bickford | 4/191 |
| 3,048,851 | 8/1962 | Bickford | 239/208 |
| 3,110,038 | 11/1963 | Dornbierer | 4/191 |
| 3,616,466 | 11/1971 | Davis | 4/191 |
| 3,737,107 | 6/1973 | Wright | 239/588 |

*Primary Examiner*—John J. Love
*Assistant Examiner*—Michael J. Forman
*Attorney, Agent, or Firm*—Dowell & Dowell

[57] ABSTRACT

An adjustable shower assembly in which the shower head is connected by way of an elongated flexible hose or tube to a source of fluid under pressure in which the flexible hose is supported under a substantially constant and uniform tension to thereby permit selective vertical adjustment of the shower head while preventing flexing, twisting or vibration of the flexible hose due to the forces applied thereto during adjustment of the shower head or due to fluid pressures within the hose.

8 Claims, 4 Drawing Figures

Fig. 1
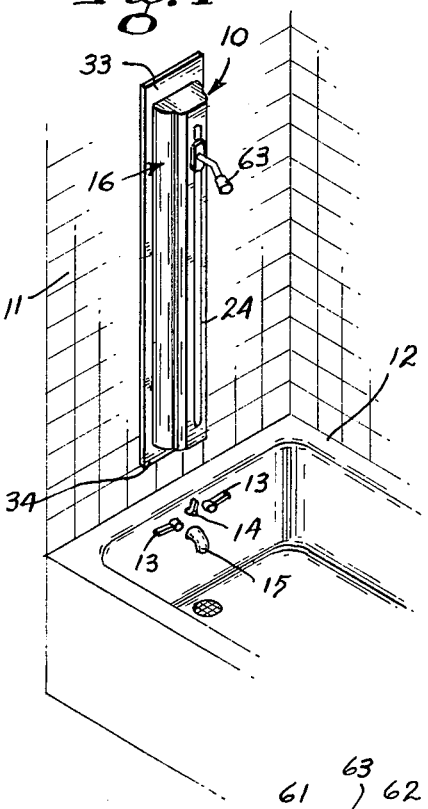
Fig. 2
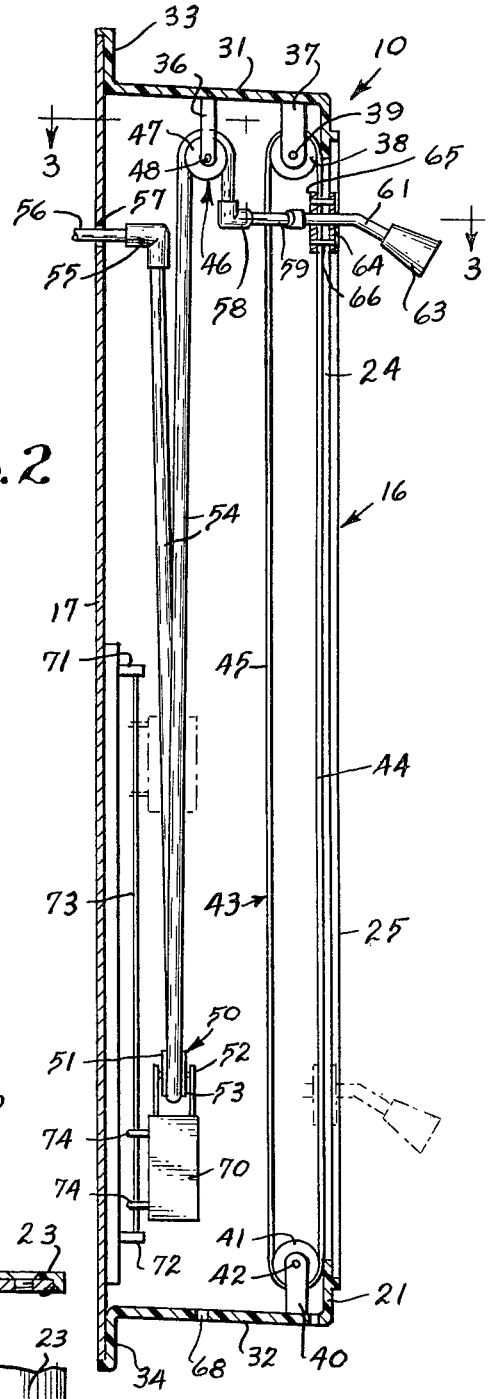
Fig. 3
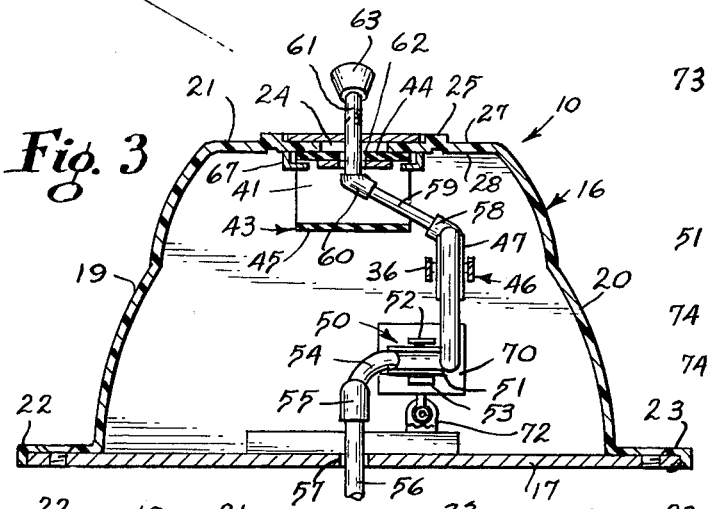
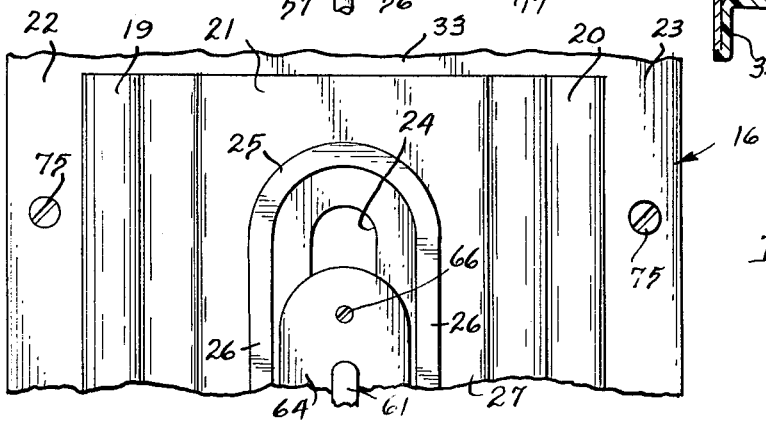
Fig. 4

ADJUSTABLE SHOWER HEAD

BACKGROUND OF THE INVENTION

Field of the Invention

This invention is directed generally to an adjustable shower head for use in various bath and shower enclosures and particularly to an adjustable shower head assembly in which the shower head is carried by a continuous splash guard belt which deflects liquid which might otherwise penetrate the opening traversed by the movable shower head. A flexible hose or conduit connects the movable shower head to a source of fluid under pressure and such hose is maintained under a substantially constant positive tension and is partially guided as it is moved relative to its supporting structure as the shower head is raised and lowered selectively.

SUMMARY OF THE INVENTION

This invention is embodied in an adjustable shower head unit having a housing which is mounted on the wall of a tub or shower enclosure and within which an elongated flexible hose or pipe is connected between a source of fluid under pressure and a vertically movable shower head which extends through an elongated opening in the housing. The elongated hose is supported intermediate the source of fluid and the shower head by a fixed pulley and a movable pulley. The movable pulley is positively guided in its vertical movement and is weighted so as to provide a constant tension on the flexible hose. The shower head is connected to a flexible imperforate belt having one run located contiguous to the elongated opening in the housing so as to repel water which is splashed against the housing.

It is the primary object of this invention to provide a vertically adjustable shower head assembly which replaces an existing fixed shower unit so as to permit selective vertical positioning of the shower head by manual manipulation.

It is another object of this invention to provide a vertically adjustable shower head assembly which includes an elongated hose or flexible pipe which connects the source of water supply to the movable shower head and such hose is maintained under substantially constant tension to eliminate twisting, kinking or vibration thereof.

It is another object of this invention to provide an adjustable shower head assembly in which an elongated flexible hose connects the source of fluid supply to the shower head and such hose is positively guided and aligned as the shower head is selectively lowered and raised.

BRIEF DESCRIPTION OF THE DRAWING

FIG. 1 is a perspective view illustrating the invention as mounted on the wall of a tub and shower enclosure.

FIG. 2 is an enlarged side elevational view from the left side of the invention with the housing broken away.

FIG. 3 is an enlarged section taken along the lines 3—3 of FIG. 2.

FIG. 4 is an enlarged fragmentary front elevational view of the invention.

DETAILED DESCRIPTION

With continued reference to the drawing, an adjustable shower head assembly 10 is illustrated in FIG. 1 as it would be mounted on the tiled wall 11 of an existing shower and tub enclosure 12. The shower and tub enclosure 12 is shown as having conventional hot and cold water control valves 13 and a selection valve 14 which operate to control the flow of water to either the shower head assembly 10 or the tub fill spout or spigot 15.

The shower head assembly includes an elongated substantially vertically disposed housing 16 which is hollow and generally D-Shaped in cross section as shown in FIG. 3. The housing 16 includes a generally planar rear panel or wall 17 and arcuate side walls 19 and 20 which are integrally formed with a front wall 21. With particular reference to FIG. 3, the side walls 19 and 20 include a pair of generally L-shaped flanged portions 22 and 23 which extend outwardly in generally parallel abutting relationship with the rear panel or wall 17 of the housing and thereby provide a seat into which the rear wall is removably mounted.

The side walls 19 and 20 extend outwardly from their flanged innermost portions 22 and 23 adjacent the wall 11 of the shower and tub enclosure 12 and converge relative to one another towards their outermost ends. The front wall or panel 21 is integrally connected to the outermost ends of the side walls and is disposed substantially parallel to the rear wall or panel 17.

The front wall or panel 21 has an elongated slot or opening 24 which extends substantially the full length thereof. A raised lip or enlargement 25 is provided which surrounds the opening 24 and includes a pair of spaced generally parallel side portions 26 which define a guide track. As shown in FIG. 2, the front wall 21 also includes front and rear surfaces 27 and 28.

In addition, the housing 16 includes top and bottom sections or walls 31 and 32 respectively which are integrally formed with the side walls 19 and 20 and front wall 21 so as to enclose the same at such locations. Further, such walls are sloped or downwardly inclined relative to the rear panel 17 so as to provide for drainage of any water accummulated on or within the housing 16. Also, the top and bottom walls include outwardly extending generally L-shaped flanges 33 and 34, respectively, which function similarly to flanges 22 and 23 to engage the rear panel 17. If desired, the top and bottom walls 31 and 32 may be removably mounted in any desired manner to the front and side walls.

With particular reference to FIG. 2, a pair of mounting brackets 36 and 37 are fixedly attached to the underside of the top wall 31 and extend downwardly therefrom so as to be located within the housing 16 when the top wall 31 is mounted in proper position. An elongated cylindrical roller 38 is rotatably mounted on an axle 39 carried by the mounting bracket 37 and such axle is positioned generally parallel to the front wall 21 and at least slightly above the uppermost end of the opening 24. Further, the mounting bracket 37 is positioned so that the periphery of the roller 38 is contiguous to the rear surface 28 of the front wall 21.

A mounting bracket 40 is fixedly attached to the upper surface of the bottom wall 32 in vertical alignment with the bracket 37. An elongated roller 41 is rotatably mounted on an axle 42 carried by the bracket 40 and such axle is positioned generally parallel to the front wall 21 and at least slightly below the lowermost end of the opening 24. The bracket 40 is positioned so that the periphery of the roller 41 is contiguous to the rear surface 28 of the front wall 21. A flexible substantially imperforate belt 43 is trained about the upper and lower rollers 38 and 41 in a manner to provide front and rear runs 44 and 45 respectively. The belt is substantially wider than the opening 24 in the front wall and the front run 44 slidably engages the rear surface 28 of such front wall for a purpose which will be described later.

The mounting bracket 36 is positioned between the back wall or panel 17 and the mounting bracket 37 and forms part of a fixed pulley 46. A grooved sheave 47 is rotatably mounted on an axle 48 carried by the bracket 36 and such axle is substantially parallel with the axle 39 of the roller 38. As shown best in FIG. 3, the bracket 36 supporting the grooved sheave 47 is mounted so as to be off center with respect to the upper or top wall 31 and is therefore shown as being located more closely adjacent to one side wall than the other side wall.

A travelling pulley 50 is located within the housing 16 and such pulley includes a grooved sheave 51 rotatably mounted on an axle 52 carried by a mounting bracket 53. The fixed pulley 46 and travelling pulley 50 rotatably receive the intermediate portion of a flexible hose or pipe 54, one end of which is connected by a 90° elbow 55 to a conventional nipple or fixed pipe 56 which extends through an opening 57 in the rear wall 17. The pipe 56 is connected to a source of water under pressure and such water is controlled by the valves 13 and 14. The opposite end of the hose is connected to a 90° elbow 58 located at one side of the belt 43. A short length of pipe 59 is connected at one end to the elbow 58 and the opposite end is connected to a 45° elbow 60 which is disposed substantially along the vertical centerline of the housing 16 and between the front and rear runs 44 and 45 of the belt 43.

A shower head nipple 61 is connected to the elbow 60 and extends through an opening 62 in the front run of the belt and through the slot 24 to the exterior of the housing where a shower head nozzle 63 is attached thereto. The nipple 61 is secured to the front run 44 of the belt by front and rear support plates or reinforcements 64 and 65 respectively with the front support plate slidably engaging the front surface 27 of the front wall 21 between the parallel side portions of the lip 25. The lip 25 guides the front support plate 64 as the shower head nozzle 63 is adjusted vertically along the slot 24. The rear support plate 65 is in intimate engagement with the front run of the belt and is connected to such belt and the front support plate 64 by fasteners 66.

The shower head nozzle 63 is adjustable from an upper position, as shown in full lines in FIG. 2, to a lower position, as shown in phantom lines, and movement of the nozzle along the slot 24 causes corresponding movement of the front run 44 of the belt 43 and causes the rear run 45 to move in an opposite direction. Accordingly, it is necessary that the shower head nipple 61 pass through the front run of the belt and then vear to one side to avoid the rear run as shown best in FIG. 3. Simultaneously, the front run of the belt 43 slidably engages the rear surface 28 of the front wall to substantially preclude water being discharged from the nozzle from entering the housing. At times, the side edges of the front run of the belt may have a tendency to curl away from the front wall, however, such tendency may be overcome by positioning a pair of belt guide tracks 67 along the rear surface 28 with portions of such tracks overlying the belt. Any water which finds its way into the housing between the belt 43 and the front wall will be drained from the housing by one or more drain openings 68 in the bottom wall 32.

The internal forces of the water under pressure within the hose 54 tend to cause the hose to assume a straight line position, but, due to a loop which is formed in the hose between the fixed nipple 56 and the fixed pulley 46, such tendency is prevented. However, such internal forces do have a tendency to twist, vibrate, and kink the hose. In order to avoid substantially all of the adverse tendencies of the hose and the water under pressure, the travelling pulley 50 is provided with a weighted body 70 on which the bracket 53 is mounted. As illustrated best in FIG. 3, the body 70 is oriented so that the axis of the sheave 51 is disposed generally normal to the plane of the rear wall 17 so that the sheave 51 is generally parallel thereto. Also, the sheave 51 is offset toward one side of the housing 16 so that the upwardly extending portion of the hose is substantially in alignment with the sheave 47 of the fixed pulley 46 but the axis is oriented 90° to the axis of such sheave 47.

The traveling pulley 50 is adjustably mounted adjacent to the rear wall 17 to as to be vertically movable with respect thereto. As shown in FIG. 2, a pair of vertically spaced inwardly extending posts 71 and 72 are secured to the rear panel 17 and extend into the housing 16 so as to be disposed in vertically spaced relationship with one another within the housing 16. With reference to FIG. 3, the posts 71 and 72 are mounted so as to be off-center with respect to an elongated axis through the rear wall 17. The posts 71 and 72 are vertically spaced apart by a distance which is at least approximately one-half the height of the opening 24 and such posts are connected by a vertically disposed rod or guide wire 73 or similar guiding mechanism.

The body 70 of the traveling pulley is guided in its vertical traverse by a pair of spaced eye members 74 which are fixedly secured to the body 70 and slidably receive the guide wire 73. In this manner, the traveling pulley may be selectively and slidably moved between the two posts 71 and 72. Although the body 70 may be of any desired weight, it has been determined that a body having a weight of 12 ounces (340 grams) will insure proper tensioning of the flexible hose 54.

In use, the adjustable shower head assembly is designed to be installed as an original plumbing fixture or may be readily mounted and connected for use in an existing shower enclosure. The housing 16 may be molded from various thermoplastic material or fabricated from sheet metal. In an existing shower enclosure, the existing shower head and shower head nipple are removed, after which the rear panel 17 of the housing 16 is placed against the wall 11 with the existing nipple 56 extending through the opening 57 in the rear panel. The flexible hose or pipe 54, which has already been placed about the fixed and travelling pulleys, is attached by a conventional coupling to the nipple 56. Thereafter, the remaining portions of the assembly housing 16 are fitted about the rear panel and the entire housing is secured to the wall 11 by a plurality of screws or other fastening members 75 which pass through the flanged portions 22 and 23 of the side walls or panels 19 and 20 and into the wall 11.

With the adjustable shower housing in place and the flexible pipe 54 connected to the source of liquid under pressure, the shower assembly is ready for use. If a person using the shower assembly desired to adjust the height of the shower head, it becomes only necessary to grasp the shower nozzle 63 which extends through the splash belt 43 and either slide the shower head unit up or down along the opening 24. The frictional characteristics of the continuous splash belt will hold the shower head in its selected elevated position. If desired, a locking member could be placed between the front and rear support plates 64 and 65. Such locking member, not shown, could be used to draw the support plates together, thereby binding the same against the portions of the front panel 21 which surround the opening 28.

As is apparent from the foregoing, the serpentine arrangement of the flexible tube or hose within the housing permits the shower head to be moved or selectively adjusted vertically along the opening 24 in the front wall 21. Further, as the shower head unit is raised or lowered, the weighted travelling pulley which is guided by the guide wire 73 will insure that a generally constant tension is applied to the flexible hose and that any undesirable kinking or twisting of the hose is prevented. Additionally, even when surges in water pressure are encountered, the positive guide mechanism associated with the travelling pulley will prevent any lateral shifting of the weight which could cause excess noise or misalignment of the flexible hose or pipe with the upper and lower grooved pulleys.

In addition to mounting the housing on the outer surface 11 of an existing shower wall, it is contemplated that the housing may be installed within the wall so that the front panel of the housing will be either abutting or flush with an elongated opening provided through the wall 11. Thereby the adjustable shower head will be the only portion of the shower unit which will extend from the shower wall 11.

Further, the sheave 38 could be power driven so as to enable the shower head to be adjusted from a remote position.

I claim:

1. An adjustable shower apparatus for use with a source of liquid under pressure comprising a housing having an elongated vertical opening therein, a shower head having first and second end portions, said first end portion of said shower head being disposed outwardly of said housing, said second end portion of said shower head extending through said vertical opening, said shower head being vertically adjustable along said vertical opening, an elongated flexible pipe means disposed within said housing, first connector means within said housing for connecting one end of said pipe means to said second portion of said shower head and second connector means for connecting the other end of said pipe means to the source of liquid under pressure, traveling pulley means disposed within said housing in vertically spaced relationship below the source of liquid under pressure, pipe guide means mounted within said housing in vertically spaced relationship to and above said traveling pulley means, said flexible pipe means extending from said second connector means downwardly and under said traveling pulley means and over said pipe guide means and downwardly to said first connector means, tensioning means connected to said traveling pulley means for applying a constant vertical tension on said flexible pipe means, vertically extending guide means slidably engaging said tensioning means and extending generally less than one-half the height of said housing, and means for retaining said shower head in an adjusted position relative to said elongated vertical opening in said housing.

2. The invention of claim 1 in whichsaid tensioning means include a weighted body vertically suspended from said traveling pulley means.

3. The invention of claim 1 in which said body has a weight of at least 12 ounces (340 grams).

4. The invention of claim 1 in which said vertically extending guide means includes a vertically extended guide rod member and said tensioning means is slidably connected to said guide member so as to be vertically movable along said guide member.

5. The invention of claim 1 in which said means for retaining said shower head in an adjusted position includes a continuous flexible belt means within said housing, a portion of said continuous flexible belt substantially covering said elongated opening, means for connecting said shower head to said portion of said continuous flexible belt means, and elongated guide track means associated with said housing adjacent said opening for restricting the lateral movement of said portion of said continuous flexible belt.

6. The invention of claim 1 in which said means for connecting said shower head to said portion of said continuous flexible belt means includes opposed clamping members disposed on opposite sides of said opening in said housing and engaging said portion of said flexible belt therebetween.

7. The invention of claim 1 in which said pipe guide means is axially oriented perpendicularly with respect to said travelling pulley means.

8. An adjustable shower apparatus for use with a source of liquid under pressure comprising a housing having an elongated vertical opening therein, a continuous flexible belt means mounted within said housing, a portion of said flexible belt means located adjacent to said housing and substantially covering said elongated vertical opening, shower head means mounted through said portion of said continuous flexible belt means so as to be disposed through said opening so that said shower head means is vertically adjustably carried along said opening by said flexible belt means, said housing including elongated track means adjacent to said opening for restricting the lateral movement of said portion of said continuous flexible belt, an elongated flexible pipe means connecting said shower head in fluid communication with the source of liquid under pressure, weighted travelling pulley means within said housing for tensioning said flexible pipe means in a substantially vertical direction and suspended from said flexible pipe means, a fixed pulley means mounted within said housing in vertically spaced relationship above said travelling pulley means so that said flexible pipe means extends from the source of liquid under pressure under said traveling pulley means and over said fixed pulley means, downwardly to said shower head means, guide means associated with said traveling pulley means for limiting lateral movement thereof whereby said weighted traveling pulley means applies a constant vertical tension on said flexible pipe means to as to prevent flexing and twisting of said flexible pipe means, and means for retaining said showerhead in an adjusted position relative to said elongated vertical opening.

* * * * *